United States Patent [19]

Campbell

[11] 4,098,441

[45] Jul. 4, 1978

[54] QUICK-ATTACH, UNIVERSAL GUN SLING

[76] Inventor: Max L. Campbell, 5109 Brentwood Rd., Topeka, Kans. 66618

[21] Appl. No.: 749,626

[22] Filed: Dec. 13, 1976

[51] Int. Cl.[2] ..... F41C 33/00

[52] U.S. Cl. ..... 224/1 A; 224/5 A; 224/5 E; 224/5 S

[58] Field of Search ..... 224/1 R, 1 A, 49, 58, 224/45 S, 5 E, 5 A, 5 R, 45 P, 45 R; 294/74

[56] References Cited

U.S. PATENT DOCUMENTS

| | | | |
|---|---|---|---|
| 2,915,233 | 12/1959 | Moomaw | 224/1 R UX |
| 3,182,871 | 5/1965 | Gossler | 224/1 A |
| 3,334,794 | 8/1967 | Saari et al. | 224/1 R |

*Primary Examiner*—Trygve M. Blix
*Assistant Examiner*—Jerold M. Forsberg
*Attorney, Agent, or Firm*—Schmidt, Johnson, Hovey & Williams

[57] ABSTRACT

A sling intended primarily as a temporary expedient may be instantly attached to a firearm and slipped over the user's shoulder for transport of the firearm in that manner. The sling is of essentially one-piece construction, comprising basically a ribbon of flexible material such as woven nylon fabric that has a series of eyelets at one end thereof and a socket at the opposite end thereof. After a selected one of the eyelets has been slipped over the projecting end of the barrel and drawn down against the stock, the socket may be slipped onto the butt of the firearm to complete attachment and ready the firearm for over-the-shoulder transport. The complete absence of fasteners, buckles, clamps and swivels facilitates rapid attachment and detachment, and the sling may be coiled into a compact spiral or otherwise compactly folded for storage in a convenient pocket of the user.

4 Claims, 3 Drawing Figures

QUICK-ATTACH, UNIVERSAL GUN SLING

This invention relates to shoulder straps and the like and, more particularly, to a sling which will fit virtually all sizes of shotguns and rifles and which can be virtually instantaneously attached and detached for temporary use by a hunter as an aid in carrying his firearm to and from a hunting site. Although the sling may of course remain on the selected firearm indefinitely, its simplicity in design and manner of use, coupled with its virtually universal acceptability for all firearms, makes it highly desirable as a temporary device that can be employed as may be necessary or desirable with any selected one of a number of weapons.

Costly and complicated straps abound in seemingly endless profusion but all present shortcomings that are avoided by the sling of the present invention. For example, many straps are more or less permanently attached through the use of swivels, buckles and other hardware that require skilled craftsmanship during initial installation. Most generally, straps of this type are utilized only on rifles, to the exclusion of shotguns, primarily because while a strap may be utilized to stabilize the rifle when the same is fired, such stability is not desired in a shotgun where the target is normally on the move. Thus, the hunter must lug the shotgun around by hand or in his arms even during the times that he is not actually hunting and is only carrying the shotgun to and from the hunting site.

Some primarily temporary straps have utilized a pair of slip nooses at opposite ends of the strap which fit over the barrel on the one hand, and around the stock substantially ahead of the butt on the other hand. These avoid the need for hardware and do provide a degree of interchangeability, but the relatively short distance between the two points of attachment of the strap to the gun causes the loop between the strap and the gun to be relatively small so that the strap is ill-fitting when the gun is slung over the hunter's shoulder. Moreover, the slip noose construction can be a nuisance insofar as attachment and detachment are concerned, especially when cold temperatures and blustery winds make finger-manipulation of the nooses awkward and tedious.

Accordingly, an important object of the present invention is to provide a shoulder sling for guns that is extremely easy to use and quick to attach and detach from the selected gun.

Another important object of the present invention is the provision of a sling as aforesaid which can be readily adjusted to comfortably fit individual users and can accept guns of a variety of sizes.

A further important object of this invention is to provide a sling of such design that it can be readily folded or rolled into a compact, space-saving shape, and slipped into the user's pocket when not in use.

Additionally, it is an important aim of this invention to provide a sling of such simplicity without sacrificing performance that it can be made available at a reasonable and attractive selling price. In the drawing.

The sling 10 is preferably fabricated from a ribbon of suitably strong, yet highly flexible material such as woven nylon fabric, and such ribbon presents an intermediate stretch 12 as well as a pair of opposite end stretches 14 and 16. The intermediate stretch 12 defines what may be termed the "strap" of the sling 10, while the two end stretches 14 and 16 are provided with the means of attaching the sling 10 to the firearm 18.

Figure 2:
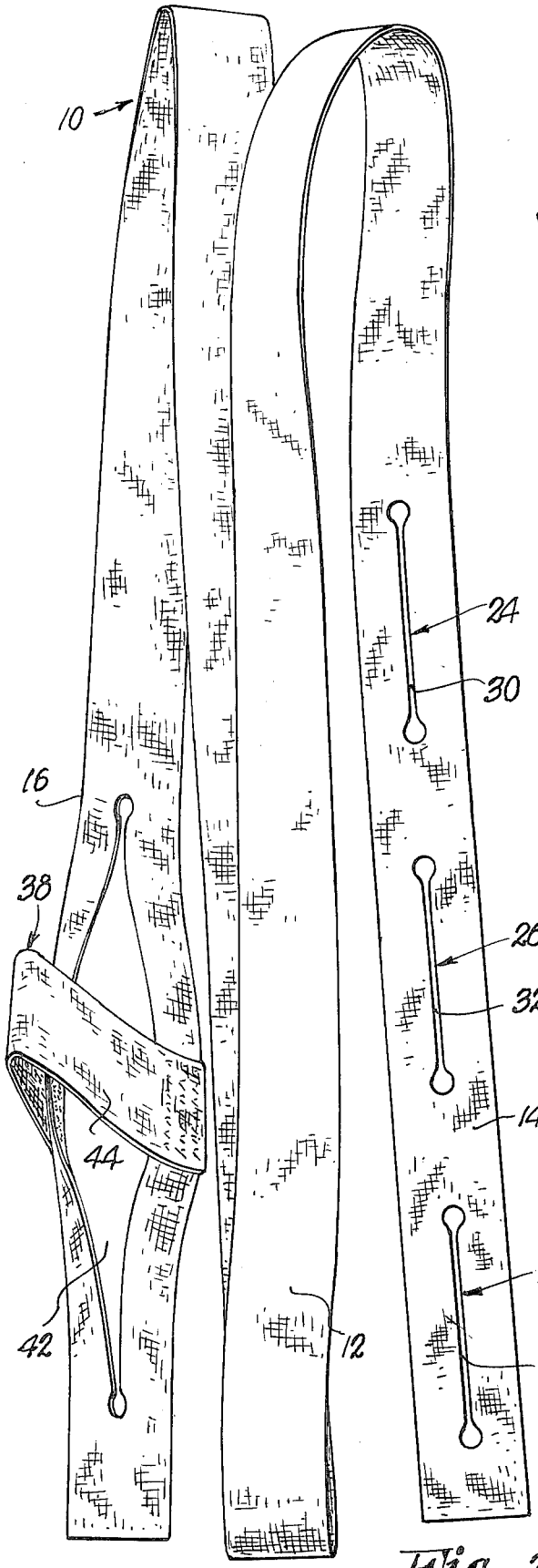
FIG. 2 is a perspective view thereof when uncoiled and prior to installation.

The end stretch 14 is attached to the barrel 20 projecting outwardly beyond the stock 22 of the firearm 18 and for this purpose is perforated to present a plurality of eyelets 24, 26 and 28 defined by longitudinal slits 30, 32 and 34 respectively as illustrated in FIG. 2. Any selected one of the eyelets 24, 26 or 28 may receive the barrel 20, depending upon the size of loop 36 desired between the firearm 18 and the intermediate stretch 12. As is apparent, the longitudinal spacing of the eyelets 24, 26 or 28 from one another permits such selectivity in the size of the loop 36.

The opposite end stretch 16 of the ribbon is also perforated, but only at a single location and only to cooperate in the presentation of a receiving socket 38 rather than a pass-through eyelet as at end stretch 14. As illustrated, the socket 38 receives the butt 40 of the stock 22 and is defined by a longitudinal opening or slit 42, together with a web 44 that bridges the slit 42 to partially close off the same. The slit 42 is of such a dimension as to readily accept the butt 40, but the web 44 prevents the latter from passing completely through the slit 42. The length of the web 44 is such that the butt 40 is received deeply within the socket 38 before bottoming-out on the web 44.

Figure 1:
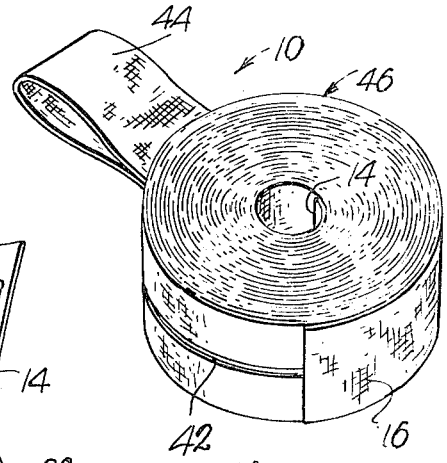
FIG. 1 is a top perspective view of a sling constructed in accordance with the principles of the present invention and coiled into a suggested compacted condition for storage during nonuse.
Figure 3:
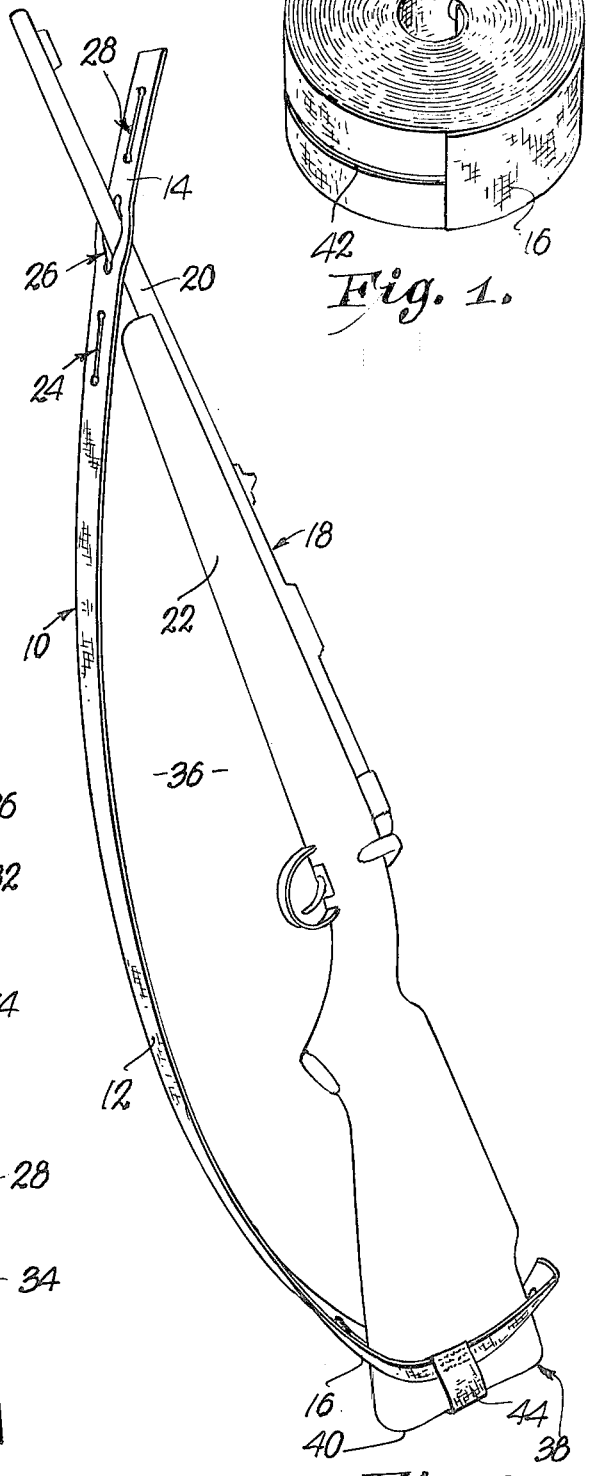
FIG. 3 is a perspective view of the sling on a reduced scale showing the manner in which it is attached to a firearm such as a rifle or shotgun.

The manner of use of the sling 10 should be readily apparent from the foregoing description of its components. Upon removing the same from its stored location (wherein the sling 10 may be rolled into a compact spiral 46 as illustrated in FIG. 1), a selected one of the eyelets 24, 26 or 28 is simply slipped over the barrel 20 down to the vicinity of the stock 22 whereupon the socket 38 is slipped onto the butt 40. Loop 36 is thus presented through which the user's arm and shoulder may be inserted for toting the firearm 18. Upward pull on the sling 10 keeps the butt 40 well seated within the socket 38, while forward and outward pull on the sling 10 keeps the selected eyelet 24, 26 or 28 on the barrel 20. Ideally, the distance between any of the eyelets 24, 26 or 28 and the socket 38 is less than the overall length of the firearm 18 so that once sling 10 is installed, it cannot be removed unless the socket 38 is first slipped off the butt 40.

Having thus described the invention, what is claimed as new and desired to be secured by Letters Patent is:

1. In combination with a firearm having a stock provided with a butt at one end thereof and a barrel projecting from the stock at the opposite end thereof, a shoulder sling for upright carriage of the firearm against the back of the user, said sling comprising:

a single, elongated, flat strap having opposite planar faces and a pair of longitudinal edges extending along lateral extremities of said faces;

an eyelet at one end of the strap removably receiving said barrel, said eyelet comprising a perforation in said strap through said opposite faces thereof having a fixed dimension that permits the strap to be freely slipped along the barrel between the outermost tip of the latter and the stock; and a socket at the opposite end of the strap removably receiving said butt so as to present a loop between the strap and the firearm for insertion of the user's arm and shoulder, said socket comprising an opening in said strap through said opposite faces thereof and a web bridging said opening in a manner to permit acceptance of the butt into the opening but prevent complete passage of the butt therethrough, the distance between said perforation and said opening being less than the length of the firearm so that the strap cannot accidentally slip off the barrel once the butt is inserted into the socket and the firearm is slung over the user's shoulder in an upright manner.

2. The combination as claimed in claim 1, wherein said perforation is in the nature of a slit extending substantially parallel to said edges.

3. The combination as claimed in claim 1; and at least one additional alternative perforation at said one end of the strap spaced longitudinally from the first-mentioned perforation.

4. The combination as claimed in claim 3, wherein each of said perforations is in the nature of a slit extending substantially parallel to said edges.

* * * * *